US010538352B2

(12) United States Patent
Mason

(10) Patent No.: US 10,538,352 B2
(45) Date of Patent: Jan. 21, 2020

(54) METHOD AND SYSTEM FOR PACKAGING A CONTAINER

(71) Applicant: JLS Automation, York, PA (US)

(72) Inventor: James L. Mason, York, PA (US)

(73) Assignee: JLS Automation, York, PA (US)

( * ) Notice: Subject to any disclaimer, the term of this patent is extended or adjusted under 35 U.S.C. 154(b) by 249 days.

(21) Appl. No.: 15/804,582

(22) Filed: Nov. 6, 2017

(65) Prior Publication Data

US 2019/0135467 A1 May 9, 2019

(51) Int. Cl.

| | |
|---|---|
| ***B65B 5/04*** | (2006.01) |
| ***B65B 35/18*** | (2006.01) |
| ***B65B 43/52*** | (2006.01) |
| ***B65D 5/02*** | (2006.01) |
| *B65B 35/24* | (2006.01) |

(52) U.S. Cl.

CPC ..... *B65B 35/18* (2013.01); *B65B 43/52* (2013.01); *B65D 5/02* (2013.01); *B65B 35/24* (2013.01)

(58) Field of Classification Search

CPC ..... B65B 5/00; B65B 5/04

USPC ..... 53/473, 467; 229/164, 101

See application file for complete search history.

(56) References Cited

U.S. PATENT DOCUMENTS

| | | | | |
|---|---|---|---|---|
| 3,032,253 | A * | 5/1962 | Younger | B65D 5/0005 229/101 |
| 5,060,455 | A * | 10/1991 | Schmeisser | B65B 21/18 53/247 |
| 5,427,306 | A * | 6/1995 | Petriekis | B65D 5/323 229/119 |
| 5,778,640 | A * | 7/1998 | Prakken | B65B 5/061 53/244 |
| 6,106,040 | A * | 8/2000 | Focke | B65B 35/18 53/473 |
| 2013/0232918 | A1* | 9/2013 | Lomerson, Jr. | B25J 15/0052 53/452 |
| 2014/0325942 | A1* | 11/2014 | Richards | B65B 5/024 53/456 |
| 2016/0039550 | A1* | 2/2016 | Boudreau | B65B 35/38 53/446 |
| 2016/0059972 | A1* | 3/2016 | Nagata | B65B 5/06 53/446 |
| 2019/0161265 | A1* | 5/2019 | Pentzer | B65D 81/2023 |

* cited by examiner

*Primary Examiner* — Gloria R Weeks
(74) *Attorney, Agent, or Firm* — Barley Snyder

(57) ABSTRACT

A method for packaging a container comprises securing a product to an end effector of a robot arm and using the robot arm to move the product. The container has a plurality of side panels, a plurality of first top flaps extending from the side panels to a first height, and a plurality of second top flaps extending from a the side panels to a second height greater than the first height. The robot arm moves the product to an initial position in which the product is positioned spaced apart from the second top flaps and over the first top flaps, from the initial position to a first deflected position in which the product abuts the second top flaps, from the first deflected position to a second deflected position lower than the first deflected position, and from the second deflected position to an undeflected position.

12 Claims, 10 Drawing Sheets

METHOD AND SYSTEM FOR PACKAGING A CONTAINER

FIELD OF THE INVENTION

The invention relates to a method for packaging a container and, more particularly, to a method for packaging a container using a robotic arm.

BACKGROUND

Systems used to automatically package a product into a container are known in the art. The known systems commonly include a robotic arm and a vision device. The robotic arm has an end effector, such as fingers or a suction device, directly interfacing with the product and used to secure the product to the robotic arm in a fixed orientation. The robotic arm moves the product to the container under the guidance of the vision device.

A known container 10 according to the prior art used in such a packaging system is shown in FIG. 1. The known container 10 has a plurality of side panels 12 and a plurality of top flaps 14 defining a product receiving space 16. Each top flap 14 extends from one side panel 12 to a same height $H_P$ in a height direction H.

The known container 10 is commonly sized to closely fit a product in the product receiving space 16, avoiding movement of the product within the known container 10 during transport. However, when the robotic arm moves the product toward the product receiving space 16 in the height direction H, the product frequently contacts a top edge of the top flaps 14 due to the close relative sizes of the product and the product receiving space 16. Contact with the top edge of the top flaps 14 during insertion requires stopping the packaging process and manually correcting the relative orientation of the product and the known container 10, decreasing manufacturing efficiency.

To address the problem of the product contacting the top flaps 14, complex end effectors of robot arms have been developed capable of tilting the held product in addition to moving the product in a fixed horizontal orientation in a three-dimensional coordinate system. The robotic arm moves the product toward the product receiving space 16 in a tilted orientation, lowers the product into the product receiving space 16, then returns the product to the horizontal orientation. These complex end effectors, however, are substantially more expensive than end effectors that are only capable of moving the product in a fixed orientation, requiring additional parts and maintenance costs.

SUMMARY

A method for packaging a container according to the invention is provided and includes securing a product to an end effector of a robot arm and using the robot arm to move the product. The container has a plurality of side panels, a plurality of first top flaps extending from the side panels to a first height, and a plurality of second top flaps extending from a the side panels to a second height greater than the first height. The robot arm moves the product to an initial position in which the product is positioned spaced apart from the second top flaps and over the first top flaps, from the initial position to a first deflected position in which the product abuts the second top flaps, from the first deflected position to a second deflected position lower than the first deflected position, and from the second deflected position to an undeflected position.

BRIEF DESCRIPTION OF THE DRAWINGS

The invention will now be described by way of example with reference to the accompanying figures, of which.

DETAILED DESCRIPTION OF THE EMBODIMENT(S)

Figure 1:
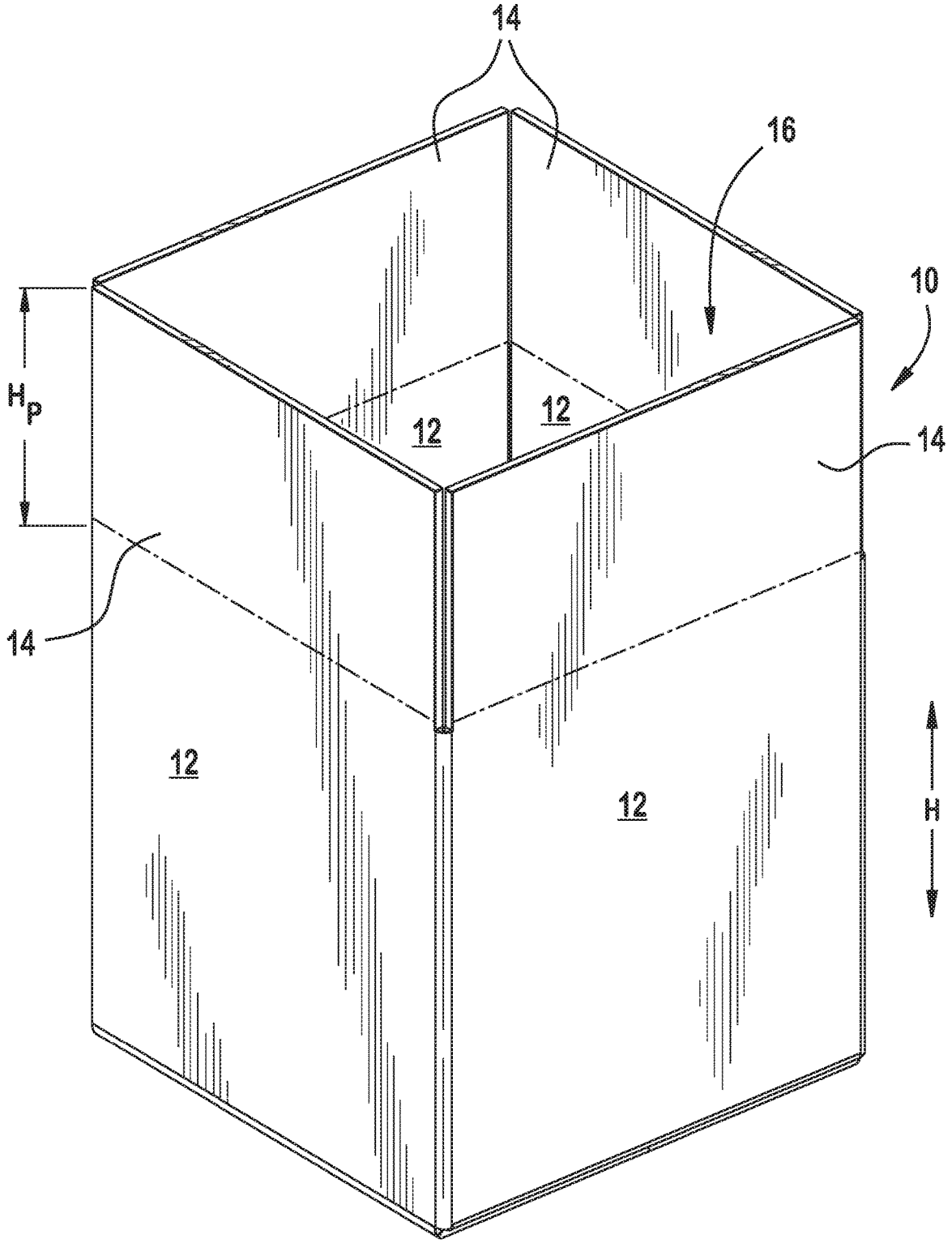
FIG. 1 PRIOR ART
FIG. 1 is a perspective view of a known container according to the prior art.

Exemplary embodiments of the present invention will be described hereinafter in detail with reference to the attached drawings, wherein like reference numerals refer to like elements. The present invention may, however, be embodied in many different forms and should not be construed as being limited to the embodiments set forth herein; rather, these embodiments are provided so that the present disclosure will be thorough and complete, and will fully convey the concept of the disclosure to those skilled in the art.

Figure 2:
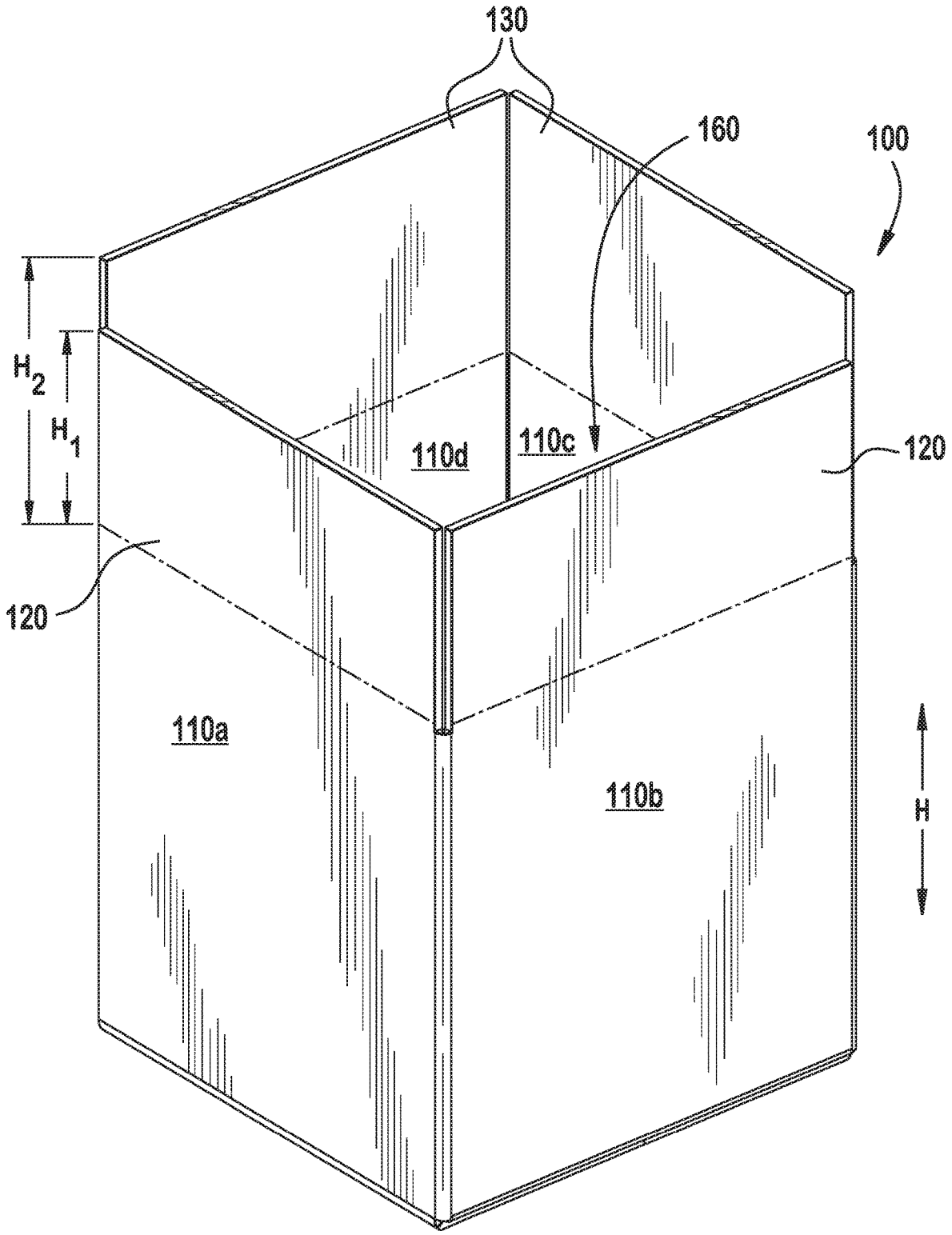
FIG. 2 is a perspective view of a container according to the invention.
Figure 3:
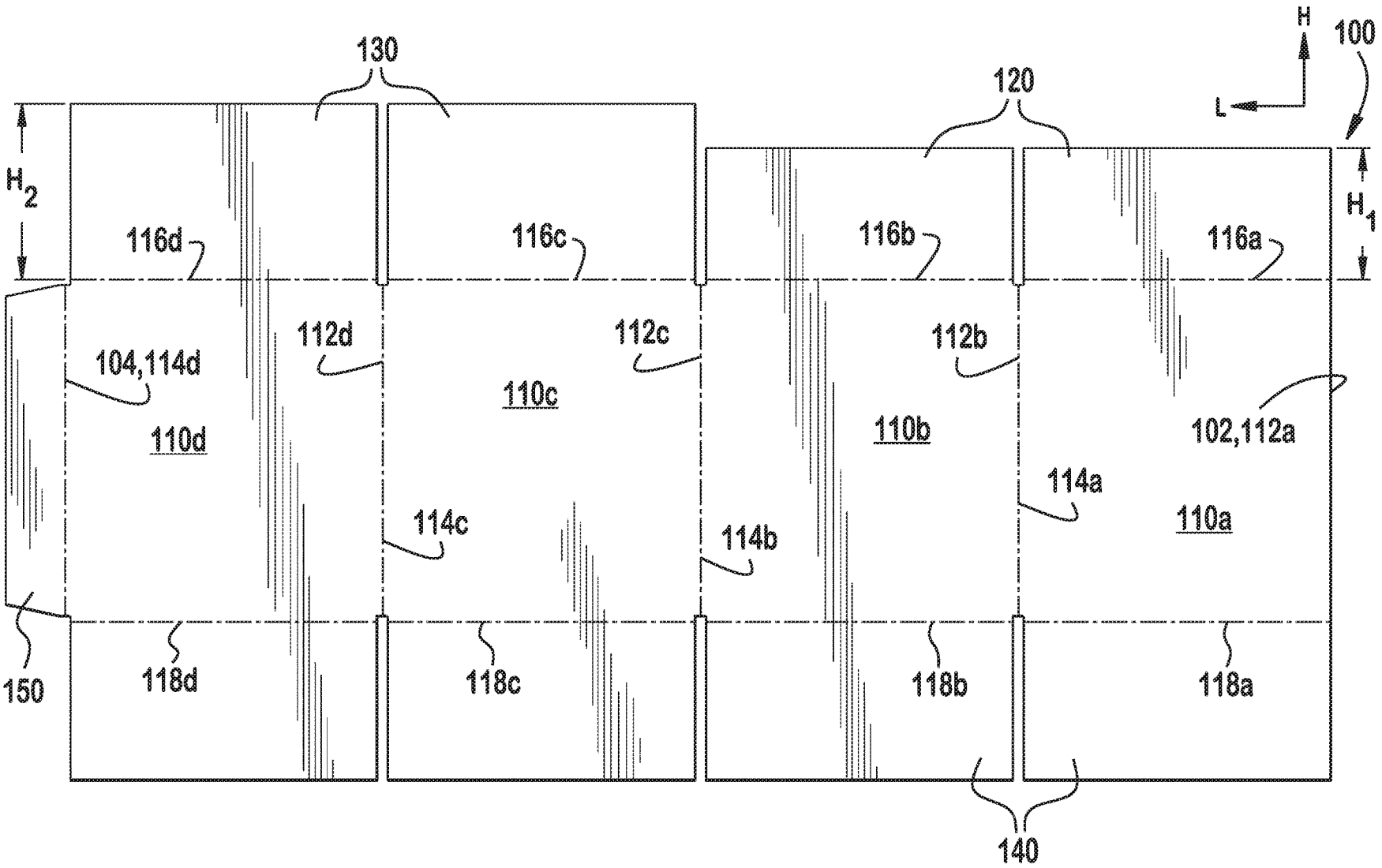
FIG. 3 is a plan view of a blank of the container of FIG. 2.

A container 100 according to the invention is shown in FIGS. 2 and 3. The container 100 generally includes a plurality of side panels 110, a plurality of first top flaps 120, a plurality of second top flaps 130, a plurality of bottom flaps 140, and an attachment tab 150.

A blank of the container 100 is shown in FIG. 3. The container 100 is monolithically formed by stamping or punching a sheet of material into the shape of the blank. In an embodiment, the container 100 is formed from a corrugated cardboard material. In other embodiments, the container 100 can be formed from any flexible material capable of being formed in a blank and assembled as described below, such as a paper, plastic, or metal material.

The plurality of side panels 110, as shown in FIG. 3, extend from a first end 102 of the blank of the container 100 to a second end 104 of the blank of the container 100 in a longitudinal direction L. Each of the side panels 110 has a rectangular shape; as would be understood by one with ordinary skill in the art, the relative dimensions of the rectangular shape will vary based on the packaging application of the container 100. Each of the side panels 110 has a first end 112, a second end 114 opposite to the first end 112 in the longitudinal direction L, a top side 116, and a bottom side 118 opposite to the top side 116 in a height direction H perpendicular to the longitudinal direction L.

In the embodiment shown in FIGS. 2 and 3, the plurality of side panels 110 include four side panels 110: a first side panel 110*a*, a second side panel 110*b*, a third side panel 110*c*, and a fourth side panel 110*d*. In other embodiments, the number of side panels 110 may vary based on the packaging application of the container 100. As shown in FIG. 3, the first end 112*a* of the first side panel 110*a* forms the first end 102 of the blank of the container 100. The second end 114*a* of the first side panel 110*a* is connected to the first end 112*b* of the second side panel 110*b*. The second end 114*b* of the second side panel 110*b* is connected to the first end 112*c* of the third side panel 110*c*. The second end 114*c* of the third side panel 110*c* is connected to the first end 112*d* of the fourth side panel 110*d*. The second end 114*d* of the fourth side panel 110*d* forms the second end 104 of the blank of the container 100.

The first top flaps 120 and the second top flaps 130, as shown in FIGS. 2 and 3, are connected to the top sides 116 of the side panels 110. The first top flaps 120 are adjacent to one another in the blank of the container 100 and the second top flaps 130 are adjacent to one another in the blank of the container 100, as shown in FIG. 3.

As shown in FIG. 3, one first top flap 120 is connected to the top side 116*a* of the first side panel 110*a* and another first top flap 120 is connected to the top side 116*b* of the second side panel 110*b*. The first top flaps 120 extend from the top sides 116*a*, 116*b* of the first and second side panels 110*a*, 110*b* to a height $H_1$ in a height direction H of the container 100. The height $H_1$ is less than the height $H_P$ of the prior art top flap 14 shown in FIG. 1.

As shown in FIG. 3, one second top flap 130 is connected to the top side 116*c* of the third side panel 110*c* and another second top flap 130 is connected to the top side 116*d* of the fourth side panel 110*d*. The second top flaps 130 extend from the top sides 116*c*, 116*d* of the third and fourth side panels 110*c*, 110*d* to a height $H_2$ in the height direction H. The height $H_2$ is greater than the height $H_1$ of the first top flaps 120 and greater than the height $H_P$ of the prior art top flap 14 shown in FIG. 1.

The bottom flaps 140, as shown in FIG. 3, are connected to the bottom sides 118 of the side panels 110. One bottom flap 140 is connected to the bottom side 118 of each of the side panels 110 and extends away from the side panel 110 counter to the height direction H.

The attachment tab 150 is attached to the second end 104 of the side panels 110, also the second end 114*d* of the fourth side panel 110*d*, and extends away from the side panels 110 in the longitudinal direction L. In the shown embodiment, the attachment tab 150 is formed in a trapezoidal shape. In other embodiments, the attachment tab 150 may be any shape known to those with ordinary skill in the art and capable of performing an attachment to assemble the container 100 as described below.

The blank of the container 100 shown in FIG. 3 is folded and attached to form the fully assembled container 100 shown in FIG. 2.

The first side panel 110*a* is folded along the second end 114*a* to be perpendicular to the second side panel 110*b*, the second side panel 110*b* is folded along the second end 114*b* to be perpendicular to the third side panel 110*c*, and the third side panel 110*c* is folded along the second end 114*c* to be perpendicular to the fourth side panel 110*d*. The attachment tab 150 is folded along the second end 104 to be perpendicular to the fourth side panel 110*d* and is attached to a surface of the first side panel 110*a*. The attachment tab 150 is attached to the first side panel 110*a* by a tape, a liquid adhesive, plastic welding, metal welding, or any other form of attachment known to those with ordinary skill in the art.

The bottom flaps 140 are folded along the bottom sides 118 to be perpendicular to the side panels 110. The bottom flaps 140 are attached to one another or to the side panels 110 by a tape, a liquid adhesive, plastic welding, metal welding, or any other form of attachment known to those with ordinary skill in the art.

The assembled container 100, as shown in FIG. 2, forms a cuboid shape and has a product receiving space 160 defined by the side panels 110 and the bottom flaps 140. In the assembled container 100, the second top flaps 130 extend from the side panels 110 to the height $H_2$ greater than the height $H_1$ of the first top flaps 120 and are adjacent one another; each second top flap 130 is opposite one first top flap 120 and each first top flap 120 is opposite one second top flap 130 in the assembled container 100. The first top flaps 120 and second top flaps 130 define a passageway extending from an exterior of the container 100 into the product receiving space 160.

Figure 4:
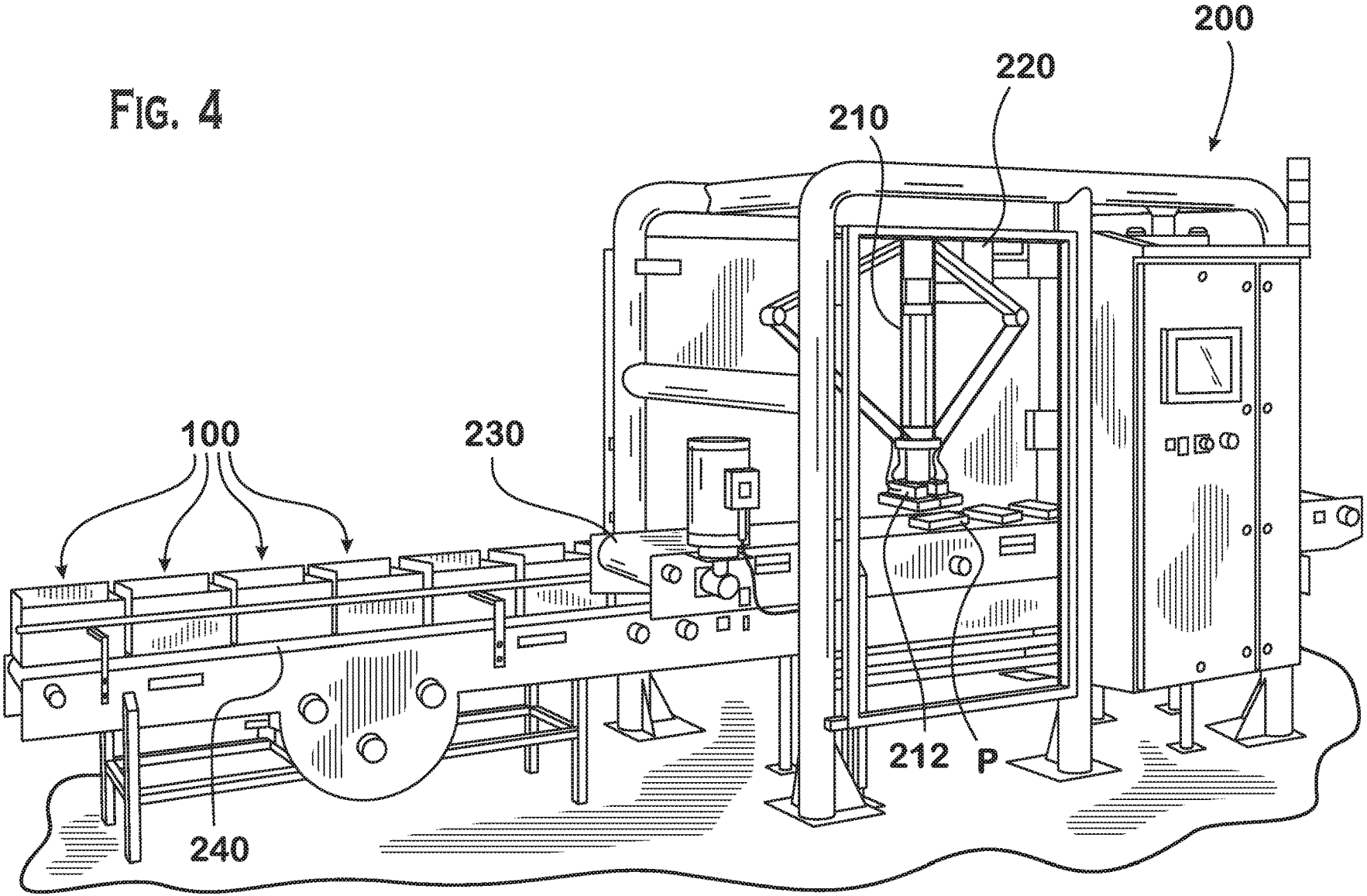
FIG. 4 is a perspective view of a system according to the invention.

A system 200 according to the invention for packaging the container 100 is shown in FIG. 4. The system 200 includes a robot arm 210 with an end effector 212, a vision device 220, a conveyor belt 230, and a roller track 240.

The conveyor belt 230 extends parallel to the roller track 240 as shown in FIGS. 4 and 5A-5F. The conveyer belt 230 may be any type of powered belt known to those with ordinary skill in the art capable of being driven in a loop and moving an item placed on the belt along a length of the belt. The roller track 240, as shown in FIGS. 5A-5F, has rollers 242 defining a receiving space for the container 100; the container 100 is movable along a length of the roller track 240.

The robot arm 210 and vision device 220, as shown in FIGS. 4 and 5A-5F, are positioned above the parallel conveyer belt 230 and roller track 240. The robot arm 210 is movable along all three axes of a three-dimensional coordinate system. The end effector 212 is fixed to an end of the robot arm 210 and is capable of directly interfacing with a product P. The end effector 210 is used to secure the product P to the robot arm 210 in a fixed orientation; the end effector 212 of the embodiment is not capable of tilting product P. In the shown embodiment, the end effector 212 is a suction end effector. The end effector 212 could alternatively be fingers grasping the product P, pins penetrating the product P, a magnet forming an electromagnetic connection with the product P, a device attaching to the product P by adhesion, or any other type of end effector known to those with ordinary skill in the art.

The robot arm 210 and end effector 212 operate under guidance of the vision device 220, and in the shown embodiment, the vision device 220 is a camera. In other embodiments, the vision device 220 may be a laser displacement sensor or any other type of vision device used in the guidance of robot arms and known to those with ordinary skill in the art.

A method of using the system 200 to package the container 100 will now be described with reference to FIGS. 5A-5F.

The product P has dimensions closely matching the dimensions of the product receiving space 160. The product P, as shown in FIGS. 5A-5F, moves along the conveyer belt 230 in a movement direction M and the container 100 moves along the roller track 240 in the movement direction M. The container 100 is positioned on the roller track 240 such that, in a depth direction D perpendicular to the height direction H and the movement direction M, one of the first top flaps 120 is positioned closer to the product P on the conveyer belt 230 than the opposite second top flap 130. In the shown embodiment, the second side panel 110*b* is positioned adjacent to the product P on the conveyer belt 230 in the depth direction D, the fourth side panel 110*d* is positioned further from the product P than the second side panel 110*b* in the depth direction D, the first side panel 110*a* is positioned downstream in the movement direction M, and the third side panel 110*c* is positioned upstream in the movement direction M; in this orientation shown in FIGS. 5A-5F, the higher second top flaps 130 are thus positioned further from the product P in the depth direction D and upstream of the product P in the movement direction M.

Figure 5A:
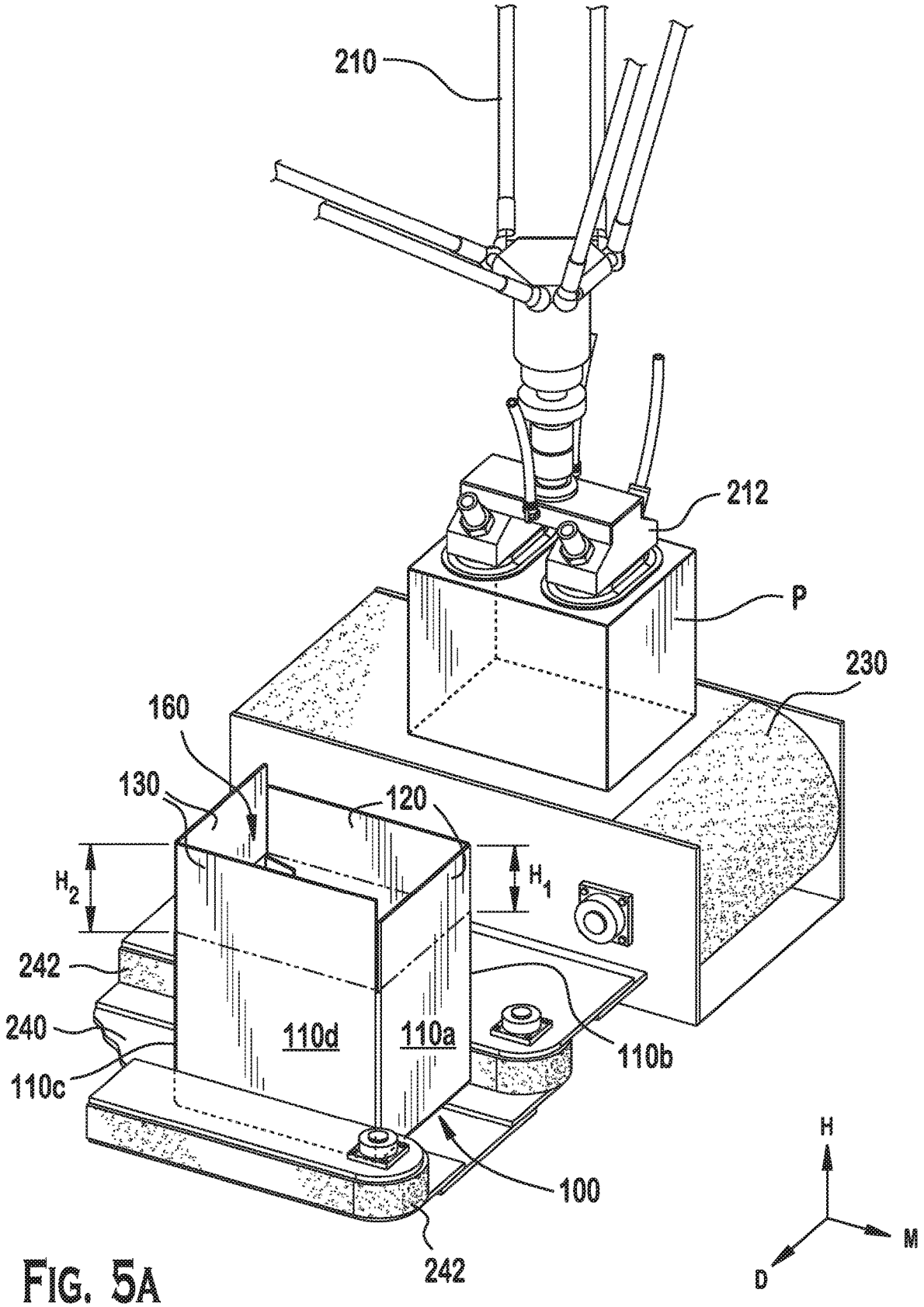
FIG. 5A is a perspective view of a first step of a method of packaging the container of FIG. 2 using the system of FIG. 4.

The first step is shown in FIG. 5A. The vision device 220 detects the product P on the conveyer belt 230. The robot arm 210 is controlled to move to the product P and attach to the product P at the end effector 212.

Figure 5B:
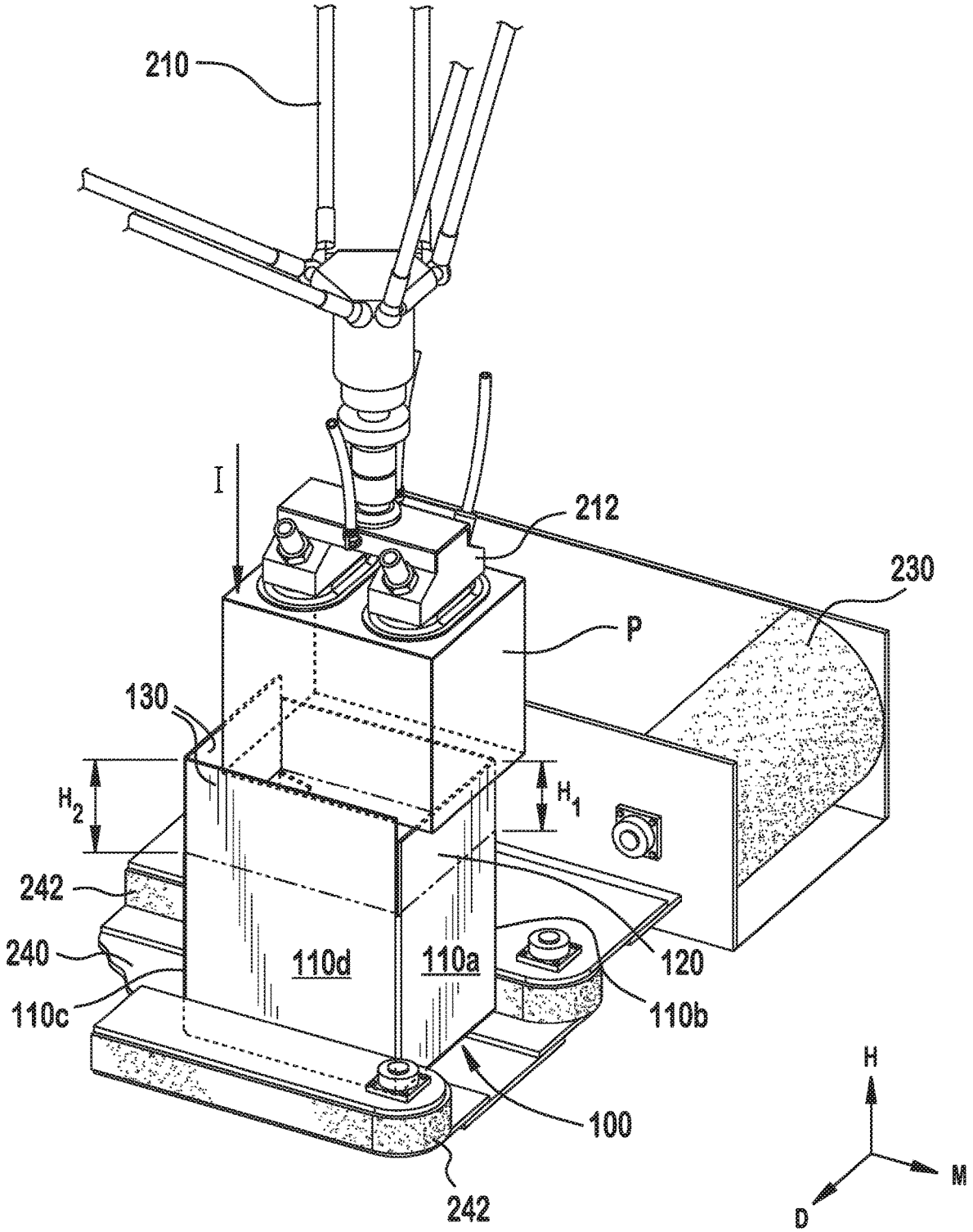
FIG. 5B is a perspective view of a second step of the method of packaging the container of FIG. 2 using the system of FIG. 4.

In the second step shown in FIG. 5B, the robot arm 210 moves the product P toward the container 100 to an initial position with respect to the container 100. The robot arm 210 positions the product P over the container 100 in the initial position as shown in FIG. 5B: in the height direction H, a bottom of the product P is positioned lower than the height $H_2$ and higher than the height $H_1$; in the movement direction M, the product P is positioned spaced apart from the second top flap 130 attached to the third side panel 110*c* upstream in the movement direction M and over the first top flap 120 attached to the first side panel 110*a* downstream in the movement direction M; and in the depth direction D, the product P is positioned spaced apart from the second top flap 130 attached to the fourth side panel 110*d* and over the first top flap 120 attached to the second side panel 110*b*. In the initial position, the product P is thus positioned lower than and spaced apart from each of the second top flaps 130 and higher than and over each of the first top flaps 120.

Figure 5C:
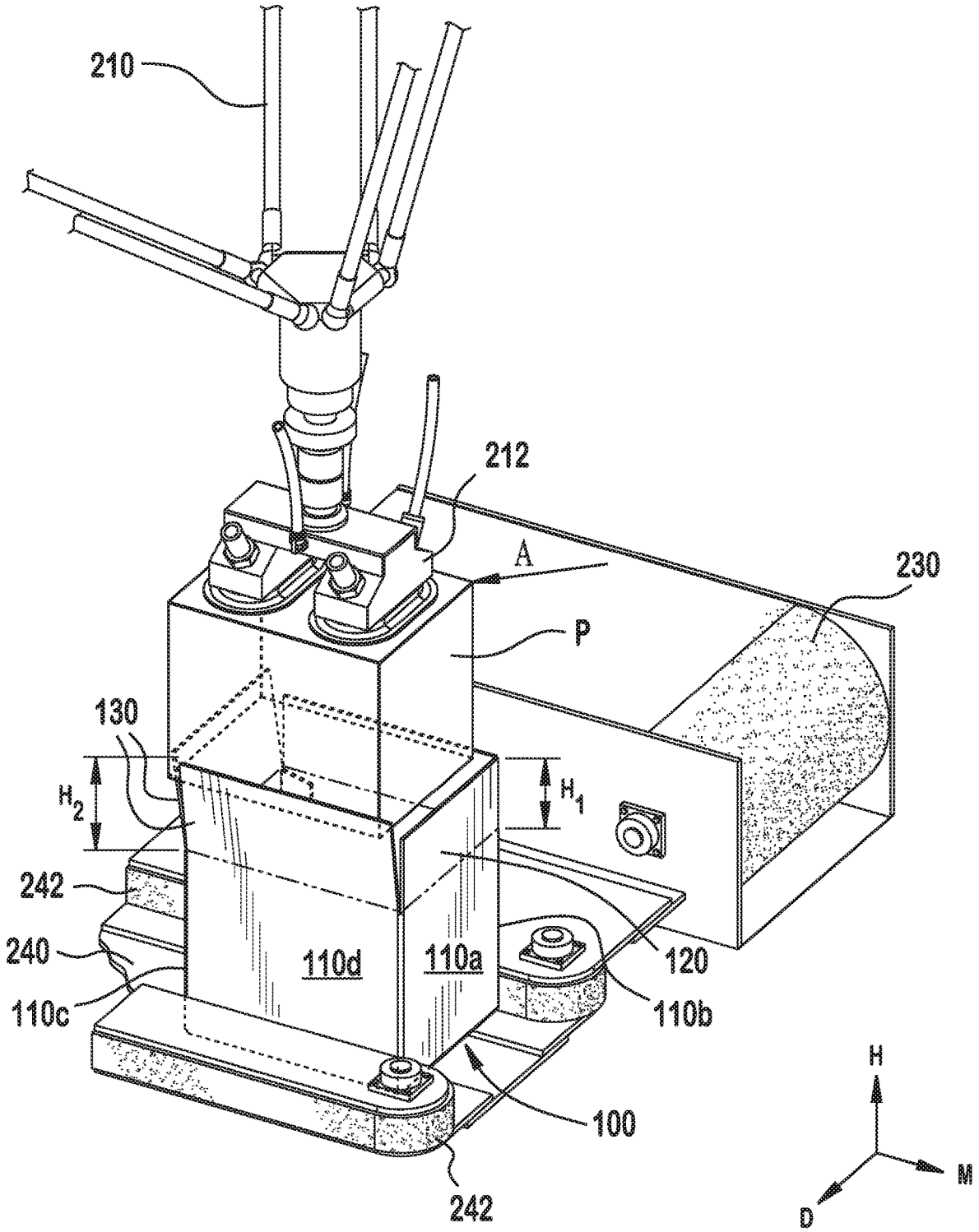
FIG. 5C is a perspective view of a third step of the method of packaging the container of FIG. 2 using the system of FIG. 4.

In the third step shown in FIG. 5C the robot arm 210 moves the product P in an adjustment direction A from the initial position to a first deflected position. The adjustment direction A is in a plane defined by the depth direction D and the movement direction M; the adjustment direction A is purely lateral and does not have a component in the height direction H. The product P is moved in the adjustment direction A until it reaches the first deflected position shown in FIG. 5C in which the product P abuts both second top flaps 130 and is no longer positioned over either of the first top flaps 120. Due to the purely lateral movement of the adjustment direction A, the bottom of the product P is still positioned lower than the height $H_2$ and higher than the height $H_1$ in the first deflected position.

Figure 5D:
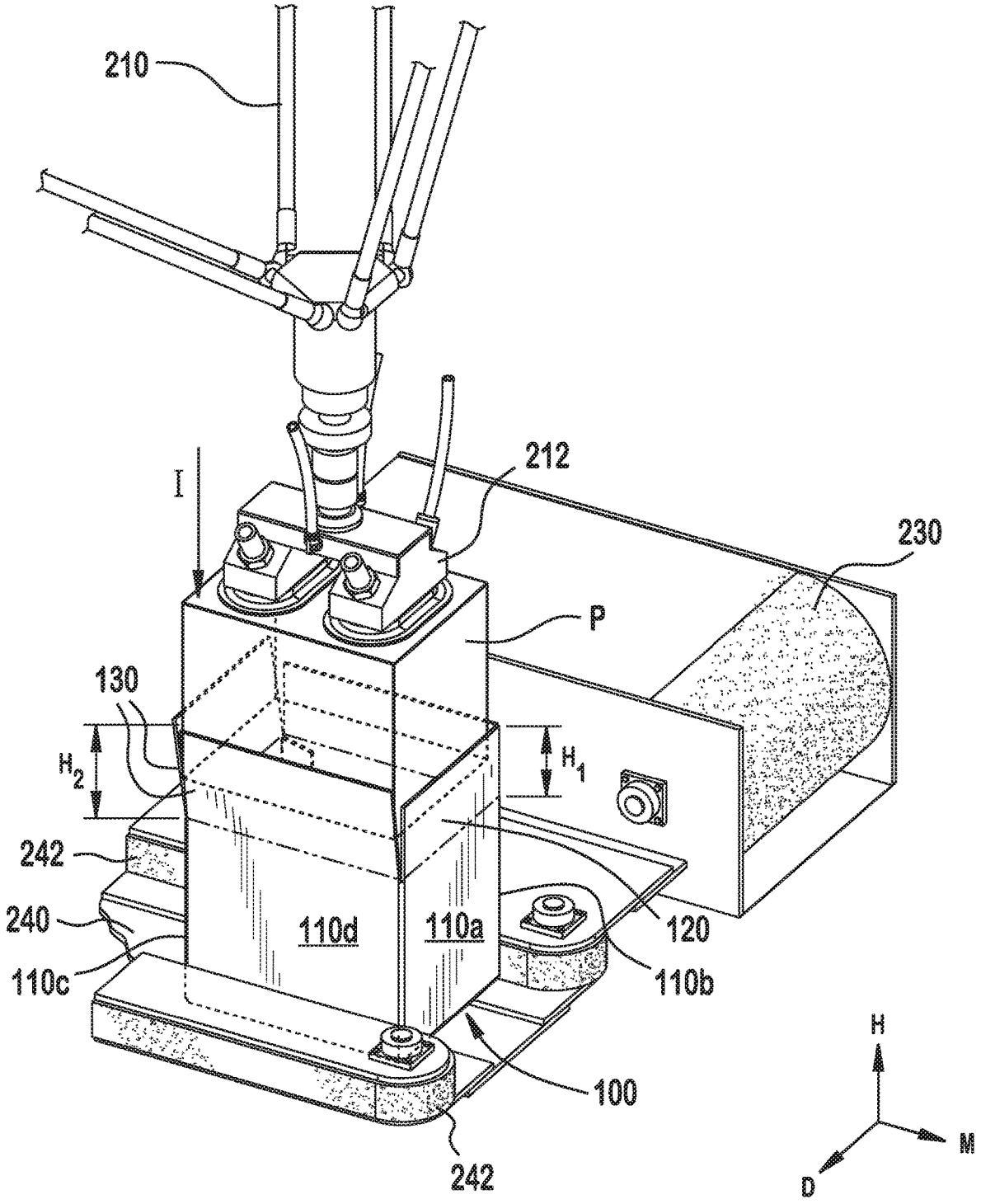
FIG. 5D is a perspective view of a fourth step of the method of packaging the container of FIG. 2 using the system of FIG. 4.

In the fourth step shown in FIG. 5D, the robot arm 210 moves the product P in an insertion direction I parallel to the height direction H from the first deflected position to a second deflected position. The product P is moved in the insertion direction I while remaining in abutment with both of the second top flaps 130 until it reaches the second deflected position shown in FIG. 5D. In the second deflected position, the bottom of the product P is positioned lower than both the height $H_2$ of the second top flaps 130 and the height $H_1$ of the first top flaps 120.

Figure 5E:
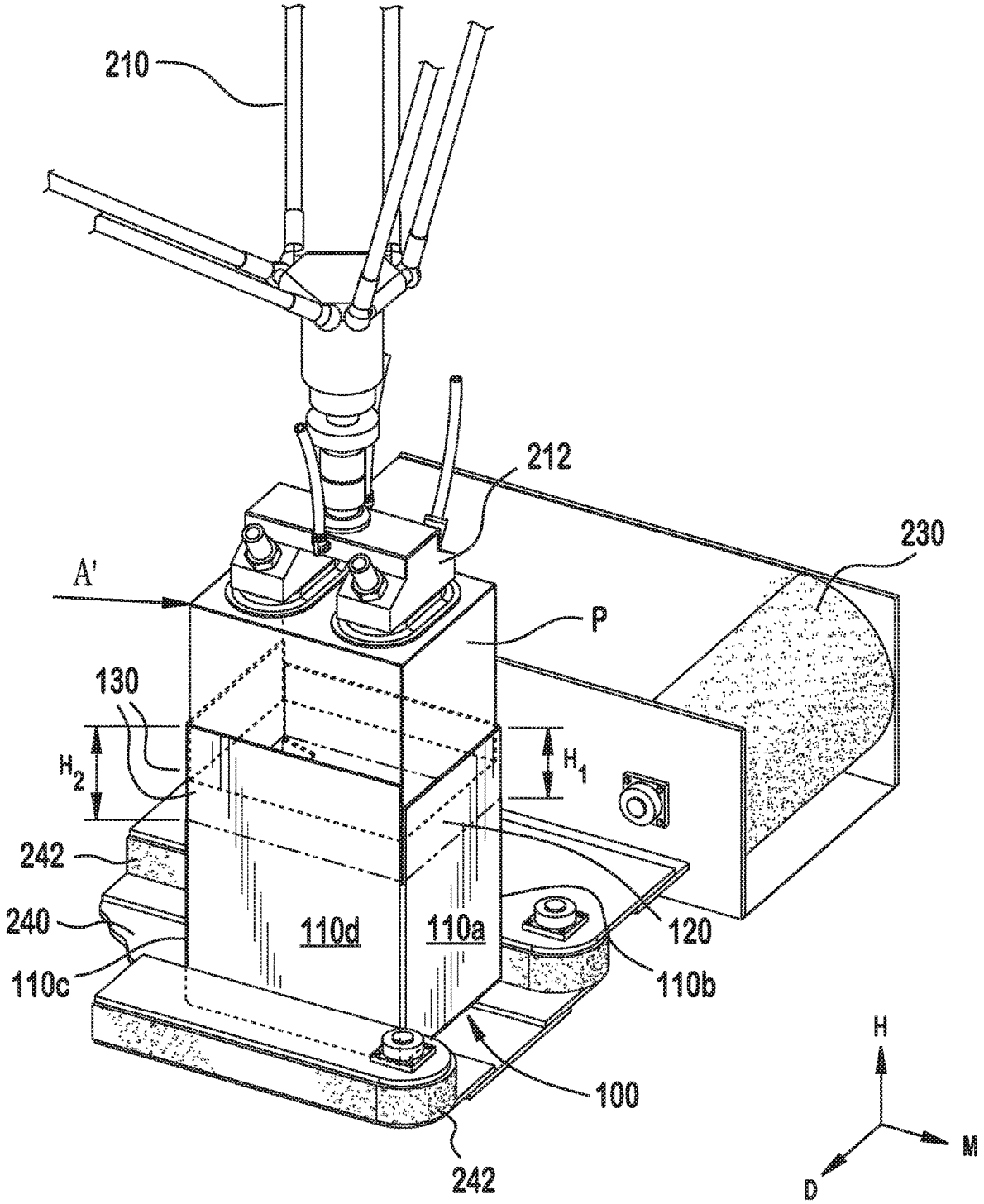
FIG. 5E is a perspective view of a fifth step of the method of packaging the container of FIG. 2 using the system of FIG. 4.

In the fifth step shown in FIG. 5E, the robot arm 210 moves the product P in a counter adjustment direction A', opposite to the adjustment direction A, from the second deflected position to an undeflected position. The counter adjustment direction A' is in a plane defined by the depth direction D and the movement direction M; the counter adjustment direction A' is purely lateral and does not have a component in the height direction H. The product P is moved in the counter adjustment direction A' until it reaches the undeflected position shown in FIG. 5E in which the product P is centered over the product receiving space 160 within the first top flaps 120 and second top flaps 130. In the undeflected position, the product P is positioned lower than both the height $H_2$ of the second top flaps 130 and the height $H_1$ of the first top flaps 120 and is equidistant from the first top flaps 120 and second top flaps 130 in the plane defined by the depth direction D and the movement direction M.

Figure 5F:
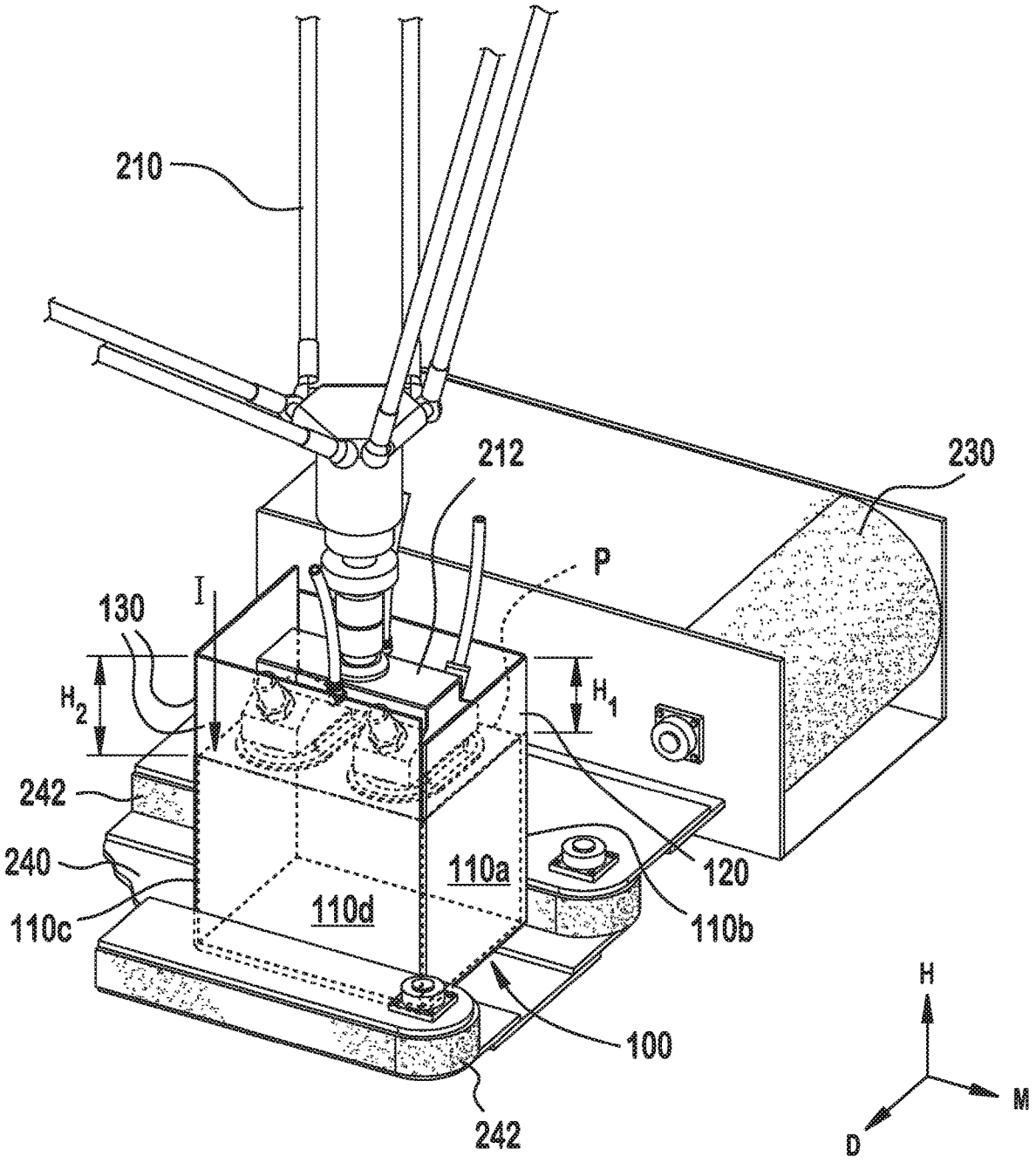
FIG. 5F is a perspective view of a sixth step of the method of packaging the container of FIG. 2 using the system of FIG. 4.

In the sixth and final step shown in FIG. 5F, the robot arm 210 moves the product P in the insertion direction I from the undeflected position to a fully inserted position. In the fully inserted position, the product P is fully inserted into and contained within the product receiving space 160 and abuts the bottom flaps 140. Throughout the steps shown in FIGS. 5A-5F, the end effector 212 holds the product P in a fixed orientation with respect to the package container 100 and does not tilt or rotate the product P. The first top flaps 120 and second top flaps 130 can then be folded and attached to one another by a tape, a liquid adhesive, plastic welding, metal welding, or any other form of attachment known to those with ordinary skill in the art to enclose the product P within the container 100.

It is further noted that the container 100 is oriented so long as the robot 210 is told what the orientation of the container 100 is. This could be a fixed orientation or it could be variable with some means (i.e., a sensor) of detecting the container 100 orientation and reporting to the robot 210.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. A method for packaging a container, comprising:

providing a container having a plurality of side panels defining a product receiving space, a plurality of first top flaps extending from a first subset of the side panels to a first height, and a plurality of second top flaps extending from a second subset of the side panels to a second height greater than the first height;

securing a product to an end effector of a robot arm; and using the robot arm to move the product:

(a) to an initial position in which the product is positioned spaced apart from the second top flaps and over the first top flaps;

(b) from the initial position to a first deflected position in which the product abuts the second top flaps;

(c) from the first deflected position to a second deflected position lower than the first deflected position in a height direction of the container; and (d) from the second deflected position to an undeflected position in which the product is centered in the product receiving space.

2. The method of claim 1, wherein a bottom of the product is positioned between the first height and the second height in the initial position.

3. The method of claim 2, wherein the bottom of the product is positioned between the first height and the second height in the first deflected position.

4. The method of claim 3, wherein the bottom of the product is positioned lower than the first height and the second height in the height direction in the second deflected position.

5. The method of claim 4, wherein the bottom of the product is positioned lower than the first height and the second height in the height direction in the undeflected position.

6. The method of claim 1, wherein the robot arm moves the product in an adjustment direction between the initial position and the first deflected position, the adjustment direction extending in a plane perpendicular to the height direction.

7. The method of claim 6, wherein the robot arm moves the product in a counter adjustment direction opposite to the adjustment direction between the second deflected position and the undeflected position, the counter adjustment direction extending in the plane perpendicular to the height direction.

8. The method of claim 1, wherein the robot arm moves the product only in an insertion direction parallel to the height direction between the first deflected position and the second deflected position.

9. The method of claim 1, wherein the product abuts the second top flaps in the second deflected position.

10. The method of claim 1, wherein the robot arm moves the product:

(e) from the undeflected position in an insertion direction parallel to the height direction to a fully inserted position in which the product is fully contained within the product receiving space.

11. The method of claim 1, wherein the end effector holds the product in a fixed orientation with respect to the robot arm.

12. The method of claim 1, wherein the side panels include a first side panel, a second side panel, a third side panel, and a fourth side panel, one first top flap extends from each of the first side panel and the second side panel, and one second top flap extends from each of the third side panel and the fourth side panel.

* * * * *